US005417263A

United States Patent [19]

Jorgensen

[11] Patent Number: 5,417,263

[45] Date of Patent: May 23, 1995

[54] LOG CHIPPER FOR LOWERING PEAK POWER REQUIREMENTS AND RAISING CHIP QUALITY

[76] Inventor: Ray B. Jorgensen, 18562 Wallingford Ave., N., Seattle, Wash. 98133

[21] Appl. No.: 104,715

[22] Filed: Aug. 11, 1993

[51] Int. Cl.[6] ..... B27C 1/00

[52] U.S. Cl. ..... 144/176; 144/162 R; 241/92; 241/298

[58] Field of Search ..... 144/162 R, 176, 373; 241/92, 296, 298

[56] References Cited

U.S. PATENT DOCUMENTS

| | | | |
|---|---|---|---|
| 3,524,485 | 8/1970 | Smith . | |
| 3,542,302 | 11/1970 | Salzmann . | |
| 4,480,667 | 11/1984 | Vaittinen et al. | 144/176 |
| 4,598,745 | 7/1986 | Parviainen . | |
| 4,827,989 | 5/1989 | Strong | 241/92 |
| 5,094,280 | 3/1992 | Kahilahti et al. . | |
| 5,129,437 | 7/1992 | Nettles et al. | 144/162 R |
| 5,139,063 | 8/1992 | Nettles et al. | 144/162 R |

*Primary Examiner*—W. Donald Bray
*Attorney, Agent, or Firm*—Robert W. Beach

[57] ABSTRACT

A log chipper is provided for allowing a lower horsepower rated motor to drive the chipper. Peak power demand is reduced by cutting shorter chips from large diameter logs, while the length of chips cut from logs of small and medium diameter continues to be of standard specified length, the length of chips cut from large diameter logs only being shortened. The feed rate for large diameter logs is reduced and will therefore result in a reduction of peak power demand achieved by the use of large diameter log positioning means. A first version of the large diameter log positioning means involves the placement of a raised platform on the wear plate where the outer perimeter of the large diameter log would otherwise contact the wear plate. A second version of the positioning means involves raising the heel of the knife clamp at a point where a portion of the outer perimeter of a large diameter log contacts the heel of the clamp. A third version of the positioning means involves grinding an outer face of the knife assembly where a portion of the outer perimeter of a large diameter log contacts the knife assembly. The special grind provides a unique relief angle to cause a shorter chip to be cut from the large diameter log. A final version of the large diameter log positioning means involves the inward adjustment of one of a series of sectional knife assemblies at the point where a portion of the outer perimeter of a large diameter log contacts the knife assembly.

10 Claims, 8 Drawing Sheets

Fig. 6.
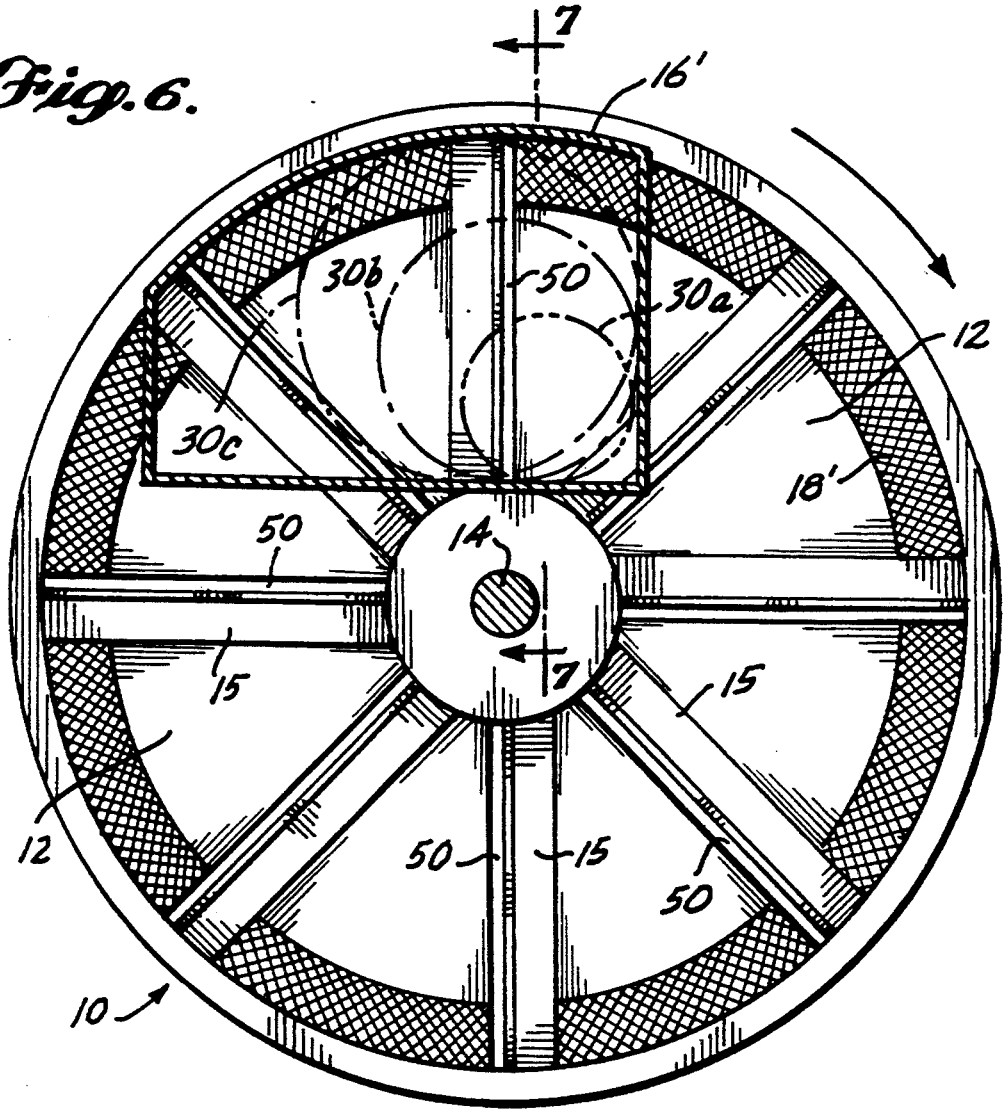
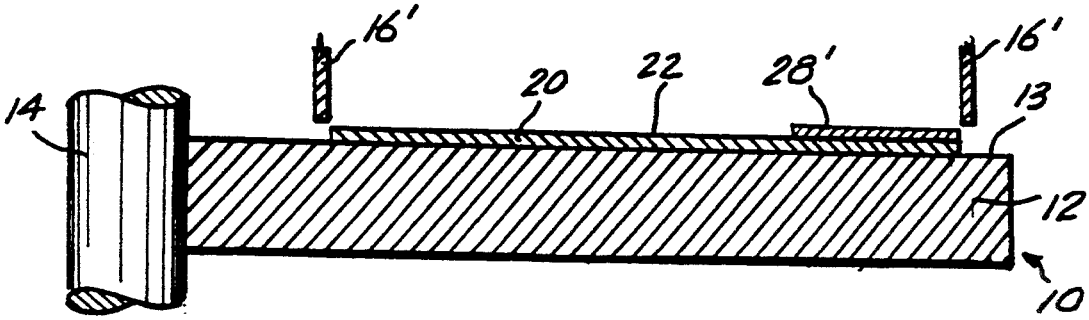
Fig. 7.

Fig. 8.
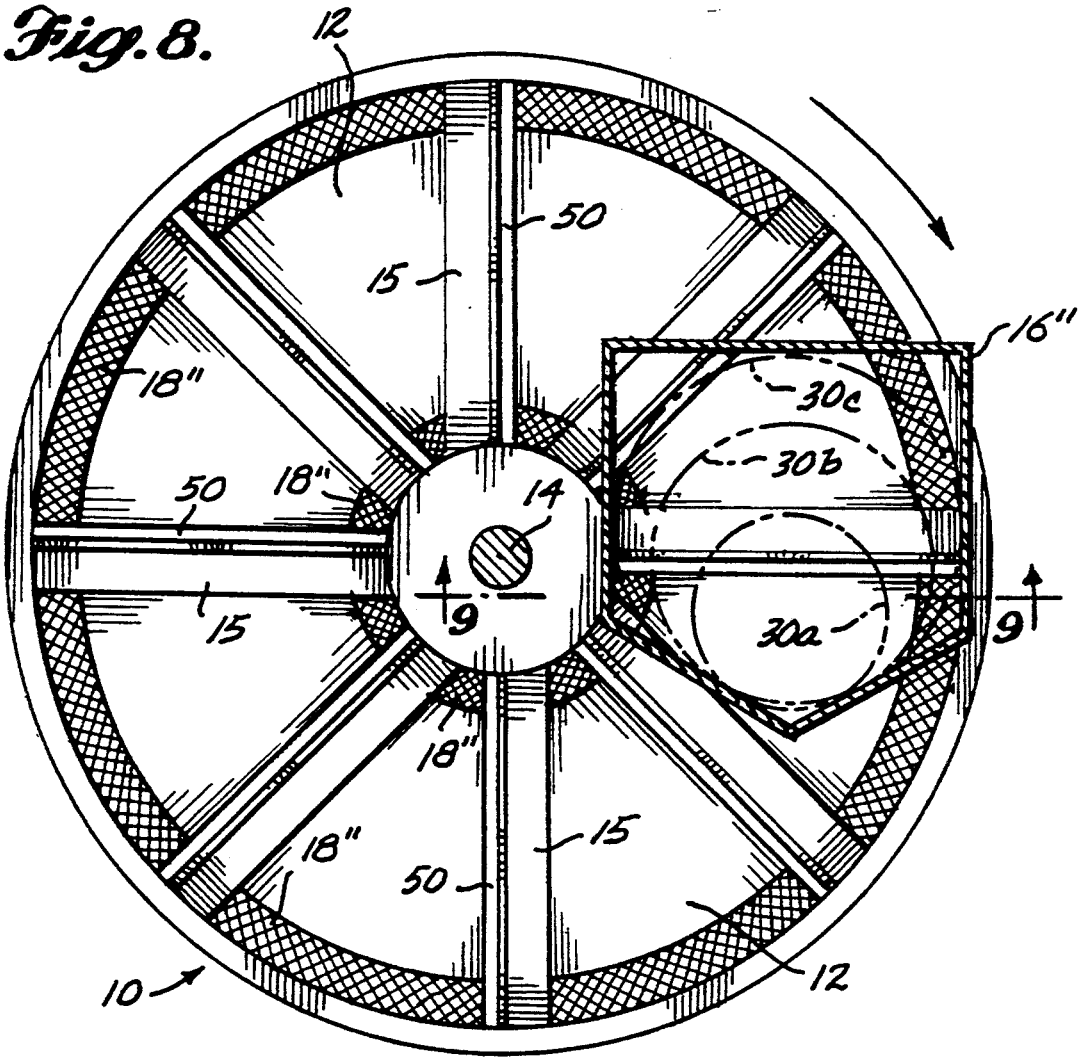
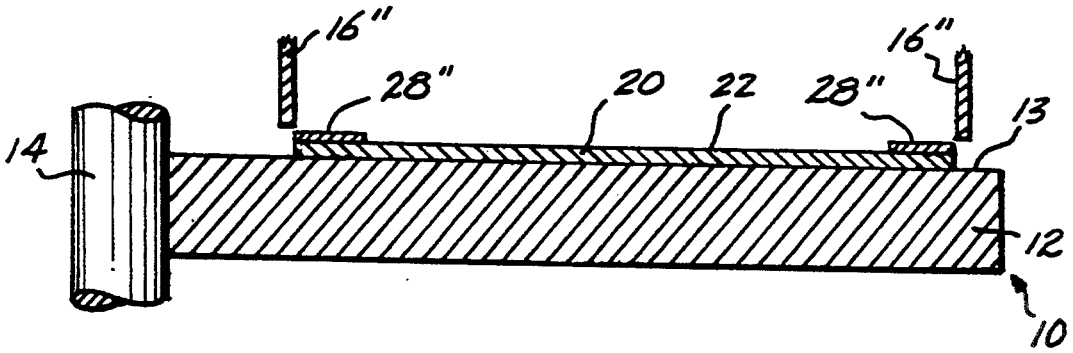
Fig. 9.

LOG CHIPPER FOR LOWERING PEAK POWER REQUIREMENTS AND RAISING CHIP QUALITY

BACKGROUND OF THE INVENTION

1. Field of the Invention

The invention relates to means for positioning logs in a disc type log chipper.

2. Problem

Disc type wood chippers for reducing logs and the like to usable chips for the paper pulp industry are well known. Generally, the chipping process includes debarking cut trees and then cutting the trees into chips for further processing into pulp from which paper is made. In the formation of the chips, debarked logs are fed into a disc chipper which includes a plurality of cutters such as knives that are mounted within recesses in the disc and adjacent to wear plates disposed on the disc. The knives cut chips from the incoming logs and pass the chips through radial openings in the disc.

3. Prior Art

While generally successful, such disc type chipping machines have suffered from certain deficiencies. Notable among the deficiencies is the difficulty in cutting chips from large diameter logs. The power requirements for chipping large diameter logs are a great deal more than for chipping smaller logs. Heretofore, it has been quite uneconomical to employ disc chipping machines that are sufficiently powerful so that they are capable of continuously chipping large diameter logs at the desired chipping rate for smaller logs.

Because of the high power demand for cutting large diameter logs quickly, attempts have been made in the past to make disc chippers more responsive to varying sizes of logs and the consequent power requirements for chipping logs of large diameter. Since most power companies charge not only according to the amount of power consumed, but also according to the peak load, the cost associated with chipping large logs can be very high. This situation is of special importance if the chipping is taking place at a remote location where producing the necessary power is very difficult.

Such prior art attempts have included elaborate means for detecting a deceleration of the disc chipper due to the load imposed on the chipper by a large diameter log. Upon the detection of deceleration, the advance of the log is halted by a discontinuation of power to the log feeding belt and by holding the log in this halted position by a complicated hydraulically operated swing arm. Additional drawbacks to this type of chipping operation are the necessary inclusion of a complex feed mechanism to the disc chipper. The feed mechanism is subject to mechanical and electrical repairs and maintenance, which adds to the total cost of chipping logs. Furthermore, a system of this type is heavier and larger than a disc chipper without the additional log feed machinery. This makes it more difficult to move a disc chipper of this type into remote locations. This prior art system has been implemented for some portable chipping applications, but large diameter log chip quality using this system usually suffers due to the frequent stopping of the log. Furthermore, the upstream feed of logs to the chipper disc must be halted whenever the swing arm is activated. Halting the upstream feed of logs drastically slows down the chipping operation, and in some cases is very difficult to control.

Other prior art attempts have included the complicated use of control means for reversing the operation of the feeding rollers of the disc chipper. The control means comprise sensing means for monitoring the speed of the disc and the use of electric valves and time relays to control hydraulic motors in the forward and reverse directions. Through the use of this type of disc chipper, there is less likelihood of chipper deceleration, and a system of this type does diminish the power requirements in bringing the disc up to speed after a deceleration. However, the control systems for a disc chipper and log feed mechanism of this design is of such complexity that a highly skilled technician would be necessary to repair a disc chipper of this type. There would also be a substantial investment for machinery of this type. Due to the halting of the feed of logs to the chipper, the swing arm log stopper system and the feed monitoring system are both inadequate for large scale chipping operations that require more than one log at a time to be fed to the chipper. Halting the upstream log feed becomes too costly and difficult for such large scale applications.

Still other prior art disc chippers have incorporated other complex machinery to make chippers responsive to the increased power requirements of chipping large diameter logs. Attempts at saving power have also included the use of heavy flywheel attachments to the disc shaft. This type of machinery allows the use of a lower horsepower motor than needed otherwise. However, this type of chipper is limited to handling large diameter logs that are short, i.e., six to eight feet in length. Another drawback is that discs with flywheels spend more power to accelerate up to speed.

4. Additional Power Problem

A related power problem within the design of disc chippers is the number of knives on a given disc. The production rate for a disc chipper is primarily determined by the rate at which small diameter logs are processed. By doubling the number of knives on a given disc, the production rate for these small logs is doubled. Unfortunately, it is the amount of power required to chip the largest diameter logs that usually determines the number of knives on the disc, since the large diameter logs determine the peak power requirements. So, even though a designer may desire the higher production rates of a disc with many knives, ultimately the designer is limited by the high power requirements of chipping large diameter logs.

For the foregoing reasons, there is a need for a disc type log chipper that is capable of continuously chipping large diameter logs without being so powerful that it is uneconomical to operate. There is also a need that the entire disc chipper system, including log feed mechanism, be inexpensive to manufacture, simple in its construction, and both as small and light as possible to permit utilizing the chipper at a remote location.

SUMMARY OF THE INVENTION

The present invention aims to overcome the problems associated with prior art disc type log chippers by utilizing means to control the position of logs at the disc. Thereby, the advancing of a log is also controlled which enables the disc chipper to operate at speeds most desirable for the formation of chips and to minimize peak power requirements.

Briefly described, the invention disclosed hereby utilizes a new manufacture of replaceable disc wear plates that have log positioning means in the form of raised platforms extending from the outer surface of the wear plate toward incoming logs fed endwise into the disc chipper. The log positioning means are disposed at a region on the disc where a portion of the margin of the ends of large diameter logs engages the log positioning means. This position is dependent upon the type of log feed spout. Other embodiments of the invention involve adjusting the position of the log against the chipper disc such that a shorter chip is cut from a large diameter log than is cut from medium or small diameter logs.

The power requirements for cutting chips from large diameter logs is appreciably reduced as the power necessary to cut shorter chips is proportionally less than that required to cut longer chips. The decreased power requirements permit the use of less expensive, lower horsepower motors and starting equipment that are smaller than have been heretofore utilized by prior art log chippers. Furthermore, the disc chipper and feed mechanism system of the present invention is simple in construction, less complex and less costly to manufacture, and extremely sturdy and durable when compared with the other power reduction schemes noted above.

From the chipper design standpoint, the invention can also be viewed as increasing the production rate and improving chip quality while maintaining the same peak power requirement. These objectives are achieved by adding additional knife assemblies to the chipper disc while utilizing the log positioning means of the present invention. The additional knives will yield an increase in production rate because more chips will be cut per revolution of the chipper disc. Also, because of the additional knives there will be less distance between knives which will cause the log to be cut more smoothly and more continuously. For example, for a four knife disc, once an initial knife cuts a point on the log, the disc will travel a full quarter turn, 90 degrees, before the same point on the log is chipped again by the next knife assembly. The length of time for a quarter turn of the disc gives the log plenty of time to change attitude and even kick out from the disc which causes uneven chipping of the log. This uneven chipping yields poor quality chips. On the other hand, if the number of knives is doubled to a total of eight, the disc will only turn 45 degrees before the next knife assembly starts cutting at the point of the previous knife cut. This results in a shorter time span in which the log can be kicked out away from the surface of the disc. Consequently, the eight knife disc cuts much smoother and results in higher quality chips than the four knife disc.

The design tradeoff, however, for conventional chipper discs, is that by adding knives the peak power requirements are raised which are still determined by the size of the large diameter logs. With the log positioning means of the present invention one need not make this design tradeoff. This increase in peak power required due to the additional knife assemblies can be exactly counterbalanced by the resulting decrease in chip length cut from large diameter logs effected by the log positioning means of the present invention. Thus, there is a gain in production rate and chip quality while maintaining the same peak power requirements.

BRIEF DESCRIPTION OF THE DRAWINGS

FIG. 6 is a front elevation of a spout-over-shaft chipper disc assembly with a crisscross hatched portion indicating the location of the log positioning means.

FIG. 7 is a partial radial section through the chipper disc assembly of FIG. 6 taken on line 7—7 of that figure.

FIG. 8 is a front elevation of a drop feed chipper disc assembly with a crisscross hatched portion indicating the location of the log positioning means.

FIG. 9 is a partial radial section through the chipper disc assembly of FIG. 8 taken on line 9—9 of that figure.

DETAILED DESCRIPTION

Figure 1:
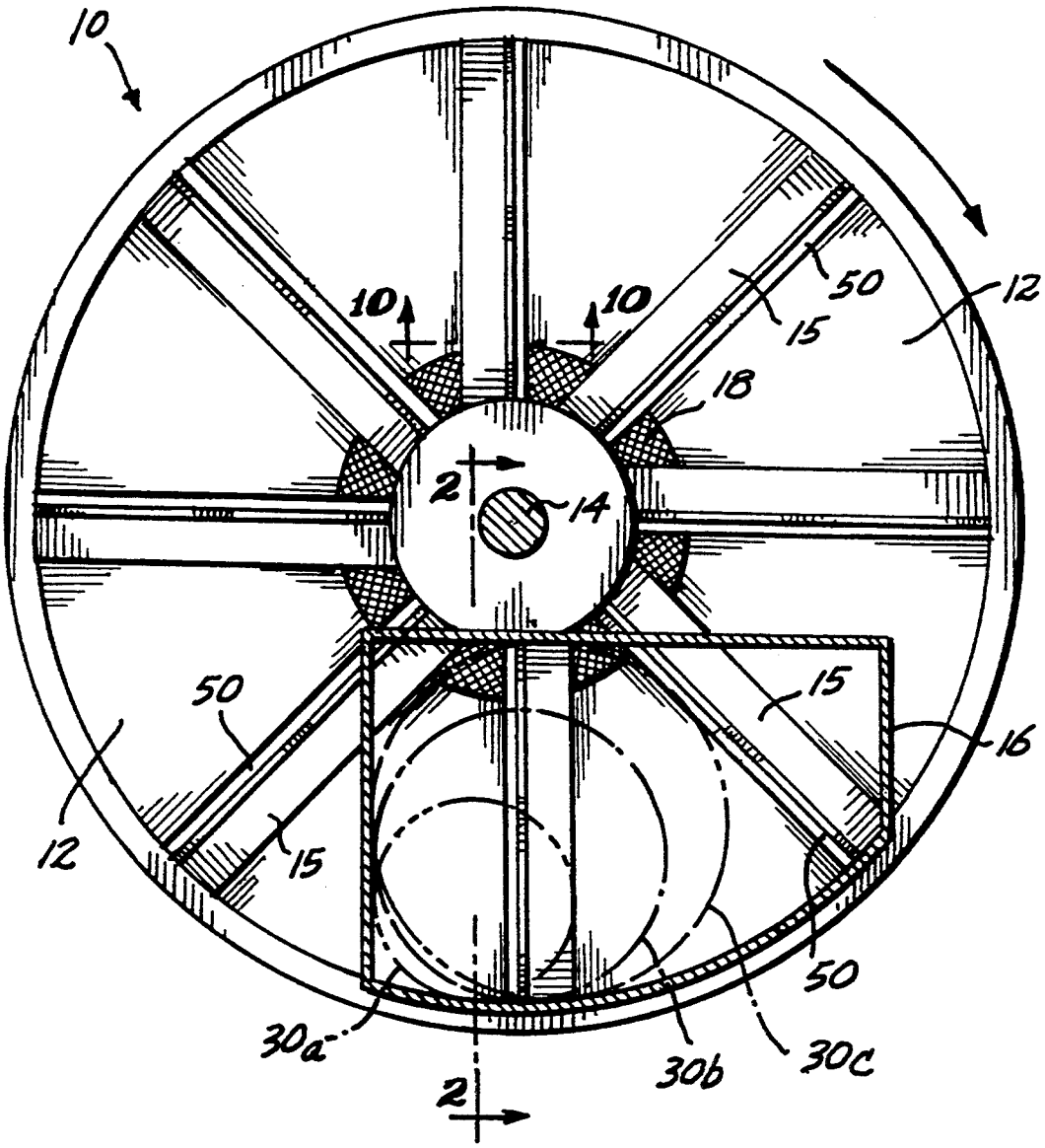
FIG. 1 is a front elevation of a spout-under-shaft chipper disc assembly with a crisscross hatched portion indicating the location of the log positioning means on the wear plate.

The peak power demand for a chipper disc is defined by the amount of power required to cut a standard length chip from a large diameter log. The present invention uses several different methods and apparatus to achieve a reduction in this peak power demand, by forcing a reduction in log feed rate for large diameter logs. However, unlike the prior art power reduction schemes, noted above, the present invention does not involve the halting of the log feed, but merely effects a slowing of the rate that the large diameter log is fed to the chipper disc.

The power required for chipping a given log for a particular chipper with a fixed number of knives, turning at a predetermined R.P.M. will be directly proportional to the chip length cut. For example, comparing the power required to cut a $\frac{5}{8}$ inch chip with the power required to cut a $\frac{7}{8}$ inch chip will yield a ratio of $\frac{5}{8}$ to $\frac{7}{8}$ which is equal to 5/7. In other words, the power required to cut a $\frac{5}{8}$ inch chip is 71 percent of the power required to cut a $\frac{7}{8}$ inch chip, gaining almost 30 percent in power reduction when the chip length is reduced $\frac{1}{4}$ inch from $\frac{7}{8}$ inch to $\frac{5}{8}$ inch.

In the past, uniformity of chip length over all chipping operations was considered very important in the industry. In recent times, however, there has been a greater concern in the pulping industry to preserve chip thickness, as opposed to chip length. Thus, the present invention, which involves slowing the feed rate of large diameter logs by cutting a shorter chip from these logs, is much more acceptable to the industry, especially since the consideration of the cost of power has become a significant factor in chipping operations.

The following example displays the power reduction benefits of the present invention. The amount of power required to chip a given log is a constant. Assume a one inch chip is desired from a chipper disc that can cut such a chip at a rate of 1 log/minute with a motor rated at 100 horsepower. The power used to chip one log would be (100 horsepower)(1 log/minute)=100 horsepower minutes. Now, if you wish to cut a $\frac{1}{2}$ inch chip from an identical log, the shorter chip length dictates a feed rate of 0.5 logs/minute, i.e., half as fast. The amount of power required to chip such a log remains constant at 100 horsepower minutes. Thus, the horsepower rating of the motor that is required to achieve this application is (100 horsepower minutes) (0.5 logs/minute)=50 horsepower.

The above example shows the basic principles used in the present invention. The drawback to shortening the chip length is that you lengthen the production time, which would be unacceptable in the industry. However, the present invention only shortens the chip length and increases the chipping time for large diameter logs. Considering that most chipping operations feed a mix of small, medium and large diameter logs through the chippers, the overall production rate is only slightly slowed using the present invention for these mixed-sized log applications. Thus, by adjusting the chip length for large diameter logs only, a significant reduction in peak power required is gained while only reducing the overall production rate slightly, and reducing slightly the chip length of the total amount of chips by volume.

Figure 2:
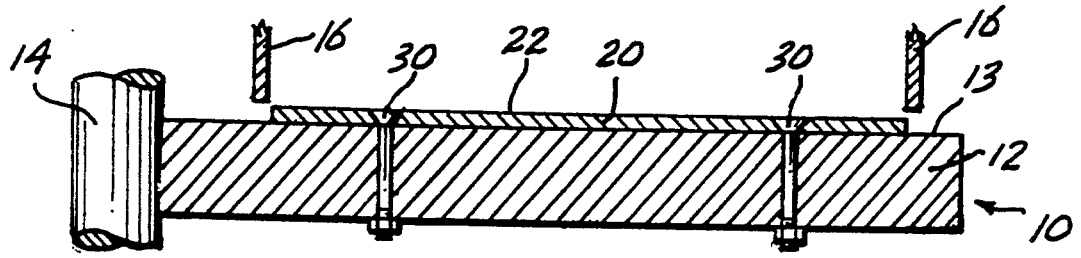
Fig. 2. (PRIOR ART)
FIG. 2 is a partial radial section through the chipper disc taken on line 2—2 of FIG. 1 showing a prior art wear plate for use on a spout-under-shaft chipper disc.
Figure 3:
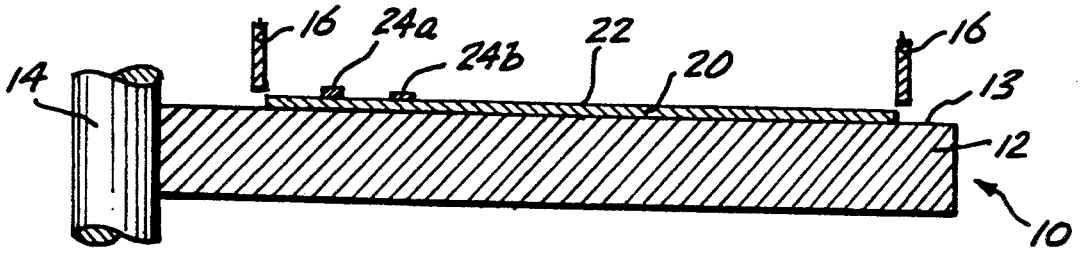
FIG. 3 is a partial radial section through the chipper disc taken on line 2—2 of FIG. 1 showing one version of the wear plate to be used in the disc chipper of FIG. 1.
Figure 4:
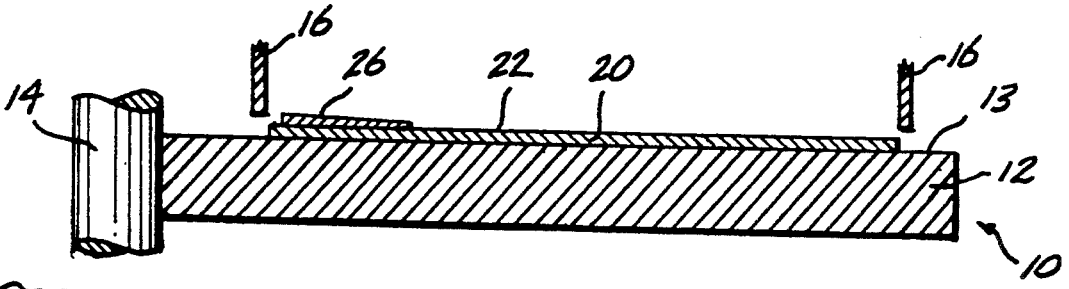
FIG. 4 is a partial radial section through the chipper disc taken on line 2—2 of FIG. 1 showing a second version of the wear plate to be used in the disc chipper of FIG. 1.
Figure 5:
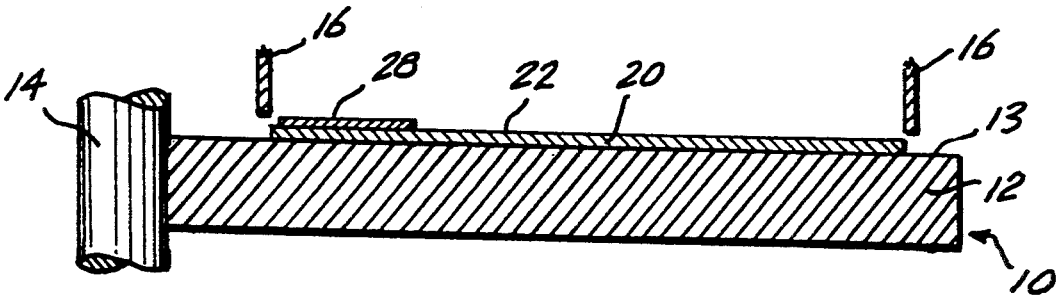
FIG. 5 is a partial radial section through the chipper disc taken on line 2—2 of FIG. 1 showing a third version of the wear plate to be used in the disc chipper of FIG. 1.

Referring to the drawings, FIG. 1 and FIG. 2 illustrate a log chipper disc assembly 10. The disc 12 is generally vertically disposed in a disc type log chipper and is secured to a shaft 14 that is rotated by power means (not shown). The materials to be chipped, such as logs, are fed endwise to the disc 12 through a spout 16. This type of log chipper is generally known in the industry as a spout-under-shaft (SUS) chipper because the spout 16 is positioned vertically beneath the shaft 14. Referring now to FIG. 2, there is shown a partial radial section through disc chipper 10 that comprises a disc 12 rotatably mounted on shaft 14. Extending through the disc 12 are radial openings 50 and adjacent to each radial opening is a knife assembly 15. Chips cut from the end of a log by the knife assembly pass through the radial openings in the disc 12. Adjacent to each knife assembly and attached to the outer surface 13 of the disc 12 are wear plates 20, as shown in FIGS. 2, 3, 4 and 5, facing toward incoming logs. Wear plate 20 comprises a substantially planar body having an outer surface 22 facing incoming logs being fed into the chipper 10. Disposed on the outer surface 22 of wear plate 20 proximate to the disc center and shaft 14 is log positioning means according to the present invention. FIGS. 3, 4 and 5 show three embodiments of log positioning means (shown in FIG. 3 as elements **24*a* and 24*b*, shown in FIG. 4 as element 26, and shown in FIG. 5 as element 28) that are disposed on the outer surface 22 of wear plate 20**.

Shown by the crisscross hatched portion 18 of FIG. 1 is the approximate location of the log positioning means proximate to the disc center. Also shown by the crisscross hatched portion 18 is the arcuate shape that is utilized for the log positioning means. The positions of logs **30*a*, 30*b*, and 30*c* fed endwise into the disc chipper 10 through the spout 16 is also shown. Smaller logs 30*a* and 30*b* are not of sufficient diameter to engage the log positioning means on the wear plate as shown by their positions below the crisscross hatched portion 18 on disc 12. Log 30*c* having a larger diameter is shown overlapping the crisscross hatched portion 18 of disc 12, thus indicating the engagement of a double-convex, biconvex or lenticular portion of the margin of the end of a large diameter log 30*c*** with the log positioning means.

Log stops **24*a* and 24*b* of the log positioning means shown in FIG. 3 have a stepped configuration, with log stop 24*a*, nearer the disc center, extending beyond the planar surface 22 of the wear plate 20 a distance farther than that of log stop 24*b*. The log stops comprise raised platforms for abutment by the ends of incoming logs of sufficient diameter fed endwise into the disc chipper 10. As shown in FIG. 3 log stops 24*a* and 24*b* are radially spaced from the disc center and separated by a gap. However, log stops 24*a* and 24*b* may be disposed on the wear plate 20 without a gap between the two stops. Also, more than two different heights of log stops could be disposed on the wear plate 20. Log stops can be attached to the wear plate with screws, or by welding, or also by being machined directly on the wear plate outer surface 22 or disc 12 surface 13**. Furthermore, the wear plate and stops could be manufactured as two separate plates that are separately mounted in radially side-by-side fashion on the chipper disc.

FIG. 4 shows a partial radial section through a second embodiment of the present invention. Disposed on wear plate 20 is log positioning means comprising a raised log stop platform 26 having a tapered outer surface. The raised platform 26 projects axially beyond the outer surface 22 of wear plate 20 for engagement with a biconvex portion of the outer margins of the ends of incoming logs of sufficient diameter. The raised platform 26 has its greatest thickness nearest the disc center and tapers radially away from the center of the disc toward the outer surface 22 of wear plate 20. The attachment of raised platform 26 can be performed by screws, a welded connection, or machined directly into the outer surface 22 of wear plate 20. The angle of taper of the log positioning means as well as the radial width of the tapered platform of the log positioning means could be varied for different chipping applications.

FIG. 5 shows a partial radial section through a third embodiment of the present invention. Disposed on the planar outer surface 22 of wear plate 20 is log positioning means comprising a log stop platform 28. Platform 28 has an outer surface substantially parallel to the disc outer surface for engagement by marginal portions of the ends of incoming logs of sufficient diameter being fed endwise into disc chipper 10. The attachment of raised platform 28 can be performed by screws, a welded connection, or machined directly on the outer surface 22 of wear plate 20. The dimensions of platform 28 could be varied for different chipping applications.

Referring again to FIG. 1, the position of logs at the disc 12 is determined by the spout 16 feeding logs endwise into the disc chipper 10. The spout 16 is positioned at the disc 12 so that all logs are engaged by the portion of the knife assemblies disposed at the outer perimeter of the disc 12. A biconvex portion of the margin of the end of each log of larger diameter, such as log **30*b*, is engaged by a radial portion of the length of the knife assembly farther from the perimeter of the disc 12 and closer to the center of the disc. The ends of the largest diameter logs, such as log 30*c***, are engaged by substantially the full radial length of the knife assembly.

Following the passing of the knife assembly the log is advanced forward toward the disc 12 and engages the outer surface 22 of wear plate 20. Or, if the log is of sufficiently large diameter, it will engage the outer surface of the log positioning means. The size of the chips cut from the log is determined by the position of the log relative to the wear plate 20, and by the extent to which the knife blades of the knife assembly extend beyond the advancement of the log.

A biconvex portion of the margins of the ends of logs of sufficiently large diameter fed into the chipper 10 contacts the outer surface of log engagement or log positioning means extending beyond the outer surface 22 of the wear plate 20 toward incoming logs. The log positioning means provide a platform for log end abutment that restricts the advancement of the log to prevent its end from abutting surface 22 of wear plate 20 after the passing of a knife assembly instead of the log end abutting wear plate 20. Because of the reduction in incremental advancement of the log the chips cut from large diameter logs are shorter than chips cut from smaller diameter logs that do not engage the platforms of the log positioning means but engage the surface 22 of wear plate 20.

The first embodiment of the present invention shown in FIG. 3 comprises a disc chipper having multiple position log stops **24*a* and 24*b* to position the ends of larger diameter logs spaced from the planar surface 22 of wear plate 20. The second embodiment of the present invention shown in FIG. 4 comprises a disc chipper having a tapered platform for positioning the ends of larger diameter logs farther from the planar outer surface 22 of wear plate 20. The ends of logs of greater diameter will be spaced further from the planar outer surface 22 of the wear plate 20, because of the taper of the platform. As shown in FIG. 5, the third embodiment of the present invention comprises a disc chipper having a platform with an outer surface that is substantially parallel to the planar outer surface 22 of wear plate 20. The log positioning means comprising platform 28 will position all logs of sufficiently large diameter at the same distance from the planar outer surface 22 of the wear plate 20**.

The extent of the log positioning means beyond the outer surface of the wear plate 20 would depend on the length of the chip desired. It would also depend on the power available to chip large diameter logs and the power savings desired by cutting shorter chips. The thicker the log positioning means platform the shorter will be the chips cut.

FIG. 2 shows a partial radial section through a chipper disc 12 having a wear plate 20 attached thereto by countersunk bolts 30 designed to fit into countersunk recesses in the outer surface 22 of wear plate 20. The radial width of the wear plate is within the radial confines of the sides of the spout 16 which prevents direct contact of the logs against the chipper disc 12. If the wear plate becomes damaged it can be replaced. Furthermore, the operator of the disc could alter the length of chip produced by the utilization of wear plates of different thicknesses. The wear plate 20 shown in FIGS. 3, 4 and 5 may be attached to the disc through the use of bolts as shown in FIG. 2. The wear plates of the present invention utilizing log positioning means could also be produced to retrofit existing disc type log chippers.

Referring to FIG. 6, a second type of conventional log chipper 10 is shown that includes a chipper disc 12 that rotates on a shaft 14 and includes eight conventional knife assemblies 15 circumferentially spaced about the chipper disc. This type of log chipper is generally known in the industry as a spout-over-shaft (SOS) chipper because the spout 16' is positioned vertically above the shaft 14. The crisscross hatched portion 18', which constitutes the means for positioning large diameter logs **30*c*, is located at the outer perimeter of the chipper disc 12 on this SOS-type chipper. The different location of the large diameter log positioning means of the present invention is dictated by the position of the spout 16' and how it feeds the smaller logs 30*a* and 30*b* toward the center of the disc, as opposed to the perimeter of the disc as in the SUS-type chipper of FIG. 1. FIG. 7 shows a partial radial section through the SOS chipper assembly of FIG. 6. In this case, the wear plate 20 is still disposed radially within the confines of the edges of the spout 16' but the raised portion 28' which constitutes the large diameter log positioning means, is disposed at the perimeter of the disc 12**.

Referring to FIG. 8 and FIG. 9, a third type of conventional log chipper 10 is shown that includes a chipper disc 12 that rotates on a shaft 14 and includes eight conventional knife assemblies 15 circumferentially spaced about the chipper disc. This type of log chipper is generally known in the industry as a drop feed spout chipper where the spout 16'' is positioned to the side of the shaft 14 at an angle (not shown in this end view) and has a troughed bottom so that the log **30*a*, 30*b*, or 30*c* drops into a centered position between the perimeter and the center of the disc 12. The crisscross hatched portions 18'', which constitute the means for positioning large diameter logs 30*c*, are located at both the outer margin and the inner margin of the chipper disc 12 on this drop feed spout chipper. The two locations of the large diameter log positioning means of the present invention is dictated by the position of the spout 16'' and how it feeds a large diameter log 30*c* such that diametrically opposite marginal portions of the large diameter log abut against log positioning means at the outer margin of the disc and at the inner margin of the disc. FIG. 9 shows a partial radial section through the drop feed chipper of FIG. 8. In this case, the wear plate 20 is still disposed radially within the confines of the edges of the spout 16'', but the raised platform portions 28'', which constitute the large diameter log positioning means, are located near the perimeter of the disc 12**, and at the inner margin of the disc.

Figure 10:
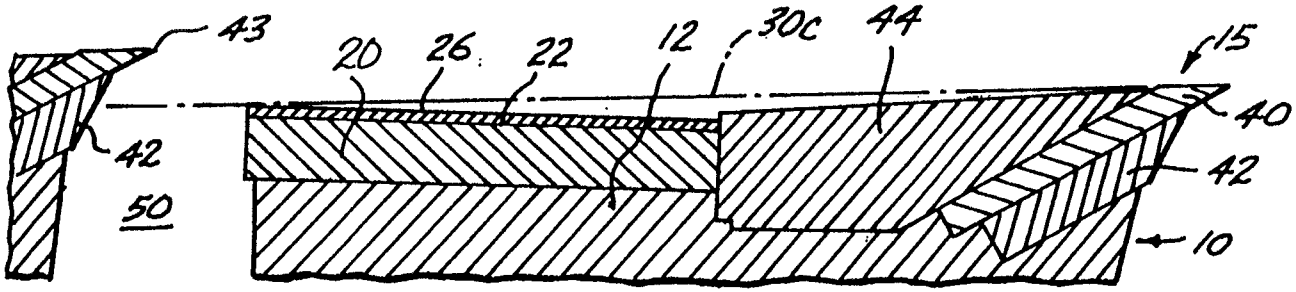
FIG. 10 is a fragmentary circumferential section through the disc chipper taken on line 10—10 of FIG. 1 showing a wear plate and knife assembly that form a first method of controlling the peak power demand for chipping logs.
Figure 11:
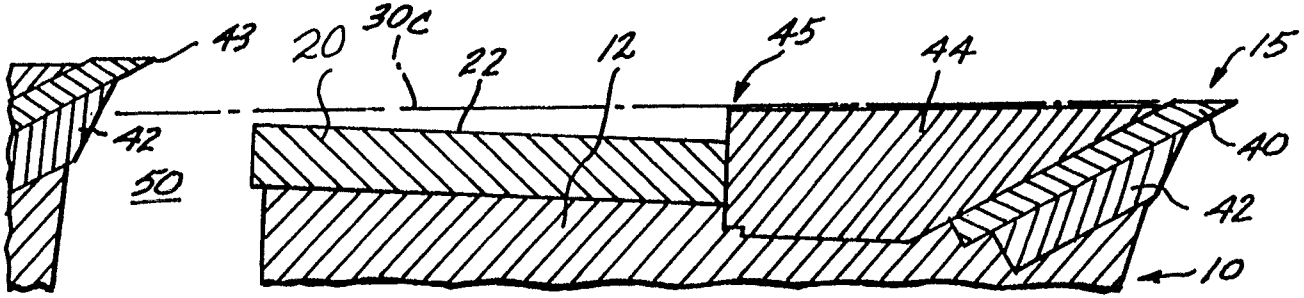
FIG. 11 is a fragmentary circumferential section through the disc chipper taken on line 10—10 of FIG. 1 showing a wear plate and knife assembly that form a second method of controlling the peak power demand for chipping logs.
Figure 12:
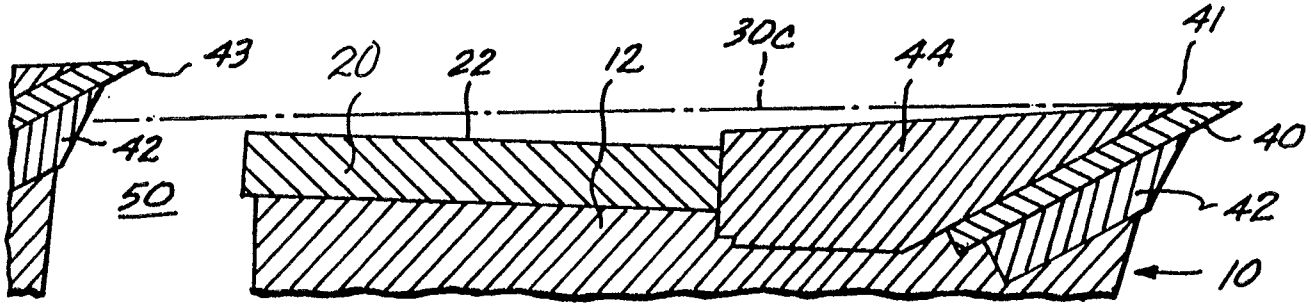
FIG. 12 is a fragmentary circumferential section through the disc chipper taken on line 10—10 of FIG. 1 showing a wear plate and knife assembly that form a third method of controlling the peak power demand for chipping logs.

FIGS. 10 to 12 depict how the incoming ends of logs of large diameter are positioned relative to the chipper disc as they are cut by the individual knife assemblies 15. FIG. 10 shows the end of a large diameter log 30C as a dashed line that abuts against the knife assembly 15 and against a raised log stop platform or portion 26 of the outer surface 22 of wear plate 20. The conventional knife assembly comprises a knife 40 held in place on the disc by a counterknife 42. A knife clamp 44 clamps the knife and counterknife to the disc in a rigid position. At the left side of FIG. 10 is shown the knife point 43 of the next knife assembly on the disc. The distance from the knife point to the log stop raised platform or portion 26 of the wear plate is shorter than the distance between the knife point and the wear plate surface 22 where the raised portion is not present. Abutment of a marginal portion of the log end against the log stop platform forces the chipper disc to cut a shorter chip decreased by the thickness of the log stop raised platform because of this shorter distance. This first method of controlling the feed of logs to the chipper disc is well suited for devices of FIGS. 3 to 5 where biconvex portions of the margins of large diameter logs will contact a raised platform on the wear plate to slow the infeed of such large diameter logs by cutting shorter chips.

FIG. 11 shows a second method by which the feed speed of a large diameter log relative to a chipper disc may be controlled. In this case the dashed line represents the end of a log, and its position relative to the disc is controlled by its engagement with the raised heel 45 of the knife clamp 44. Using this method, most of the log end is suspended away from the disc and does not touch the wear plate outer surface 22. The extended heel of the clamp can be achieved by a specially manufactured clamp that has the raised heel portion only at the radial position where an end portion of the large diameter log would contact the clamp heel. This design yields a shorter chip and slower feed rate only for large diameter logs. The shorter chip length is the result of the end of the log being spaced away from the surface 22 of the wear plate 20 because of the engagement of a portion of the log end margin with the raised heel 45 of the knife clamp 44. The left side of FIG. 11 shows that the log does not span the full length between the knife point 43 and outer surface 22 of the wear plate 20 which causes a shorter chip to be cut from a large diameter log.

FIG. 12 shows a third method by which the position of the end of a large diameter log relative to a chipper disc may be controlled. In this case the dashed line, again, represents the end of the large diameter log. The contact point for a biconvex portion of the margin of the end of a large diameter log is the outer face 41 of the knife 40. The remaining part of the log end is spaced away from the surface 22 of the wear plate 20, and does not contact the wear plate. This method of controlling the position of a large diameter log relative to the chipper disc also achieves a lower overall power required than is required by conventional disc chippers. In this case, the method is achieved by adjusting the relief angle of the outer face 41 of the knife 40. The relief angle is controlled by grinding this surface. This method works best for a chipper disc having sectional knife assemblies, as in FIG. 13, where only one section of the knife, such as the radially innermost section, need be specially ground. As in the method depicted in FIG. 11, the spacing of the log end away from the wear plate causes the log to span only a partial distance between the knife point and wear plate, resulting in cutting a shorter chip.

Conventionally, a log will span the full distanced from the knife point 43 to the surface 22 of wear plate 20 to cut a standard length chip with no savings in required power. The three above-mentioned methods lower the required power by controlling the span of the large diameter log between the knife point and wear plate. The first mentioned method involves lifting the surface of the log when it contacts raised portions on the wear plate. Thus, the log does not span the full distance between knife point 4 and the surface 22 of wear plate 20, thereby cutting a shorter chip. The second and third mentioned methods involve controlling the contact point of the log against the knife clamp and outer face of the knife, respectively. By controlling the contact points of the large diameter log at these points on the disc, the remainder of the log end is held spaced from the surface 22 of the wear plate and therefore produces a shorter chip since the log does not span the full distance between knife point 43 and the surface 22 of wear plate 20.

Figure 13:
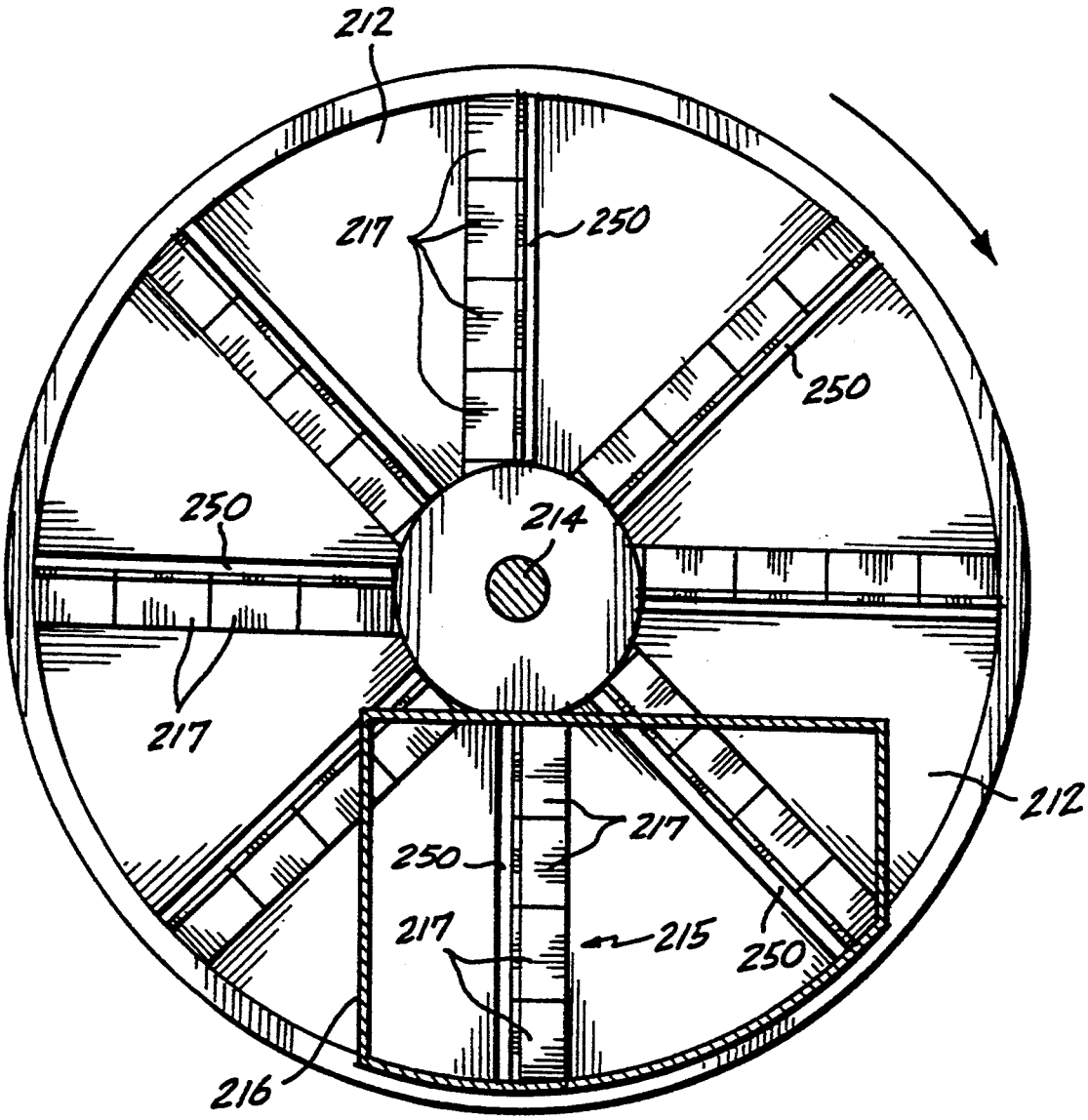
FIG. 13 is a front elevation of another modified spout-under-shaft chipper disc assembly using sectional knife assemblies that provide a fourth method to achieve the power savings of the present invention.

In FIG. 13, the disc 212 rotates with shaft 214. The disc includes eight radial openings 250 adjacent to eight lines of knife assemblies 215. A spout 216 is positioned beneath the shaft to feed logs endwise into the disc chipper. Each linear knife assembly 215 is divided sectionally into four separate knife sections 217 that are collinear with one another. The separate knife sections 217 allow the knife section closest to the center of the disc to be adjusted inwardly to shorten the distance between knife and wear plate at the perimeter of large diameter logs. This adjustment of the radially innermost knife section to shorten the chip being produced at the perimeter of a large diameter log results in lower overall power being required for the disc chipper than if all four sections 217 are adjusted to the same chip length. Thus, the use and individual adjustment of the radially innermost knife section of this modified version of a disc chipper provides a fourth method of the present invention of minimizing power required for cutting large diameter logs.

Figure 14:
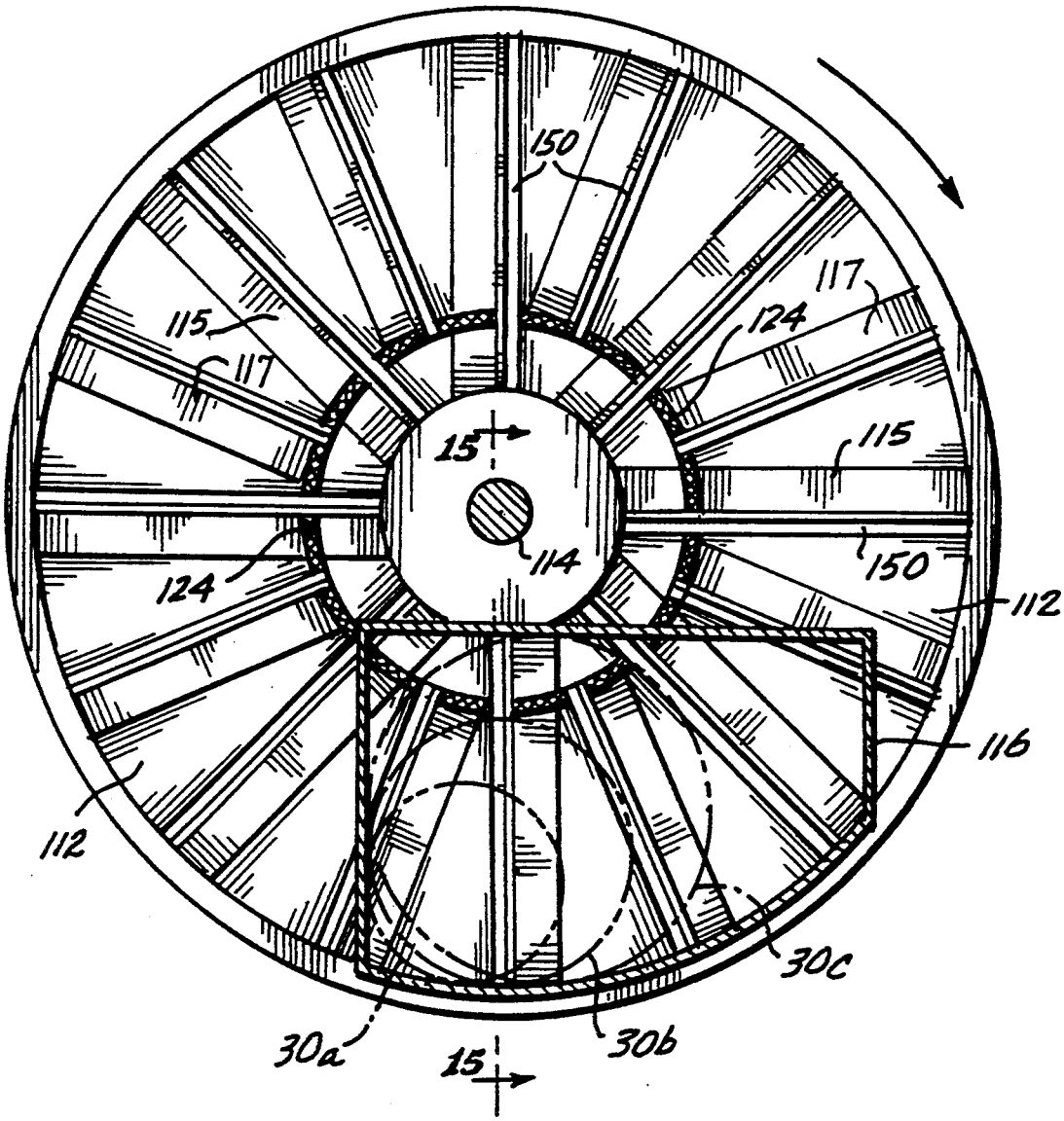
FIG. 14 is a front elevation of a modified spout-under-shaft chipper disc assembly using sixteen knife assemblies and a modified version of the log positioning means of the present invention.

FIG. 14 shows a modified disc chipper that is used in conjunction with the large diameter log positioning means of the present invention. Conventional disc chippers, as shown in FIGS. 1, 6 and 8, include eight radial openings through the disc and eight knife assemblies arranged about the center of the chipper disc. The FIG. 14 chipper disc 112 has sixteen radial openings 150 with eight long knife assemblies 115 arranged adjacent to eight of these openings alternately, and eight short knife assemblies 117 arranged adjacent to the remaining eight alternate openings, each short knife assembly lying between two adjacent ones of the long knife assemblies. The outer ends of all the knife assemblies are in the same circle and the inner ends of the eight longer knives project radially inward farther than the eight shorter knives.

Figure 16:
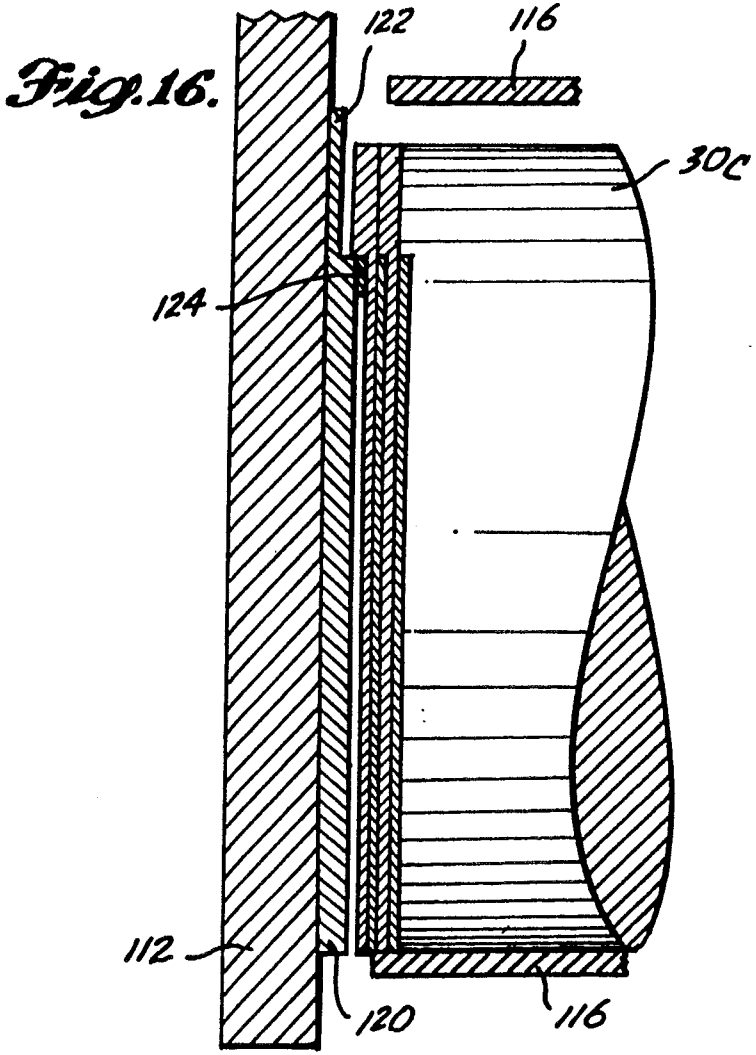
FIG. 16 is a similar section illustrating a second type of operation.
Figure 15:
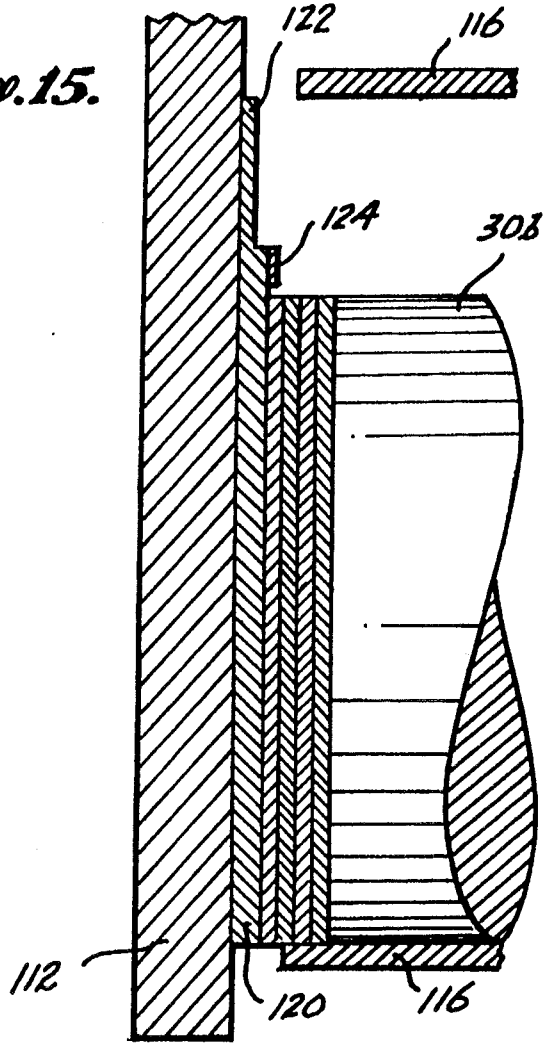
FIG. 15 is a partial radial section through the disc chipper assembly of FIG. 14 taken on line 15—15 of that figure illustrating a first type of operation.

The alternating short and long knife assemblies yield advantages that conventional eight knife disc chippers cannot achieve. The doubling of the knife assemblies doubles the production of wood chips cut from logs of small and medium diameters while requiring less than twice the power needed for an eight-knife disc chipper. A slowdown in production arises, however, for large diameter logs chipped by a sixteen-knife disc chipper. Specifically, since there is not enough room on the disc to extend all sixteen knives to the inner perimeter of the disc, only the eight longer knives will cut a biconvex portion of the outer margin of the end of a large diameter log. In order to solve this problem, log positioning means are provided adjacent to the inner perimeter of the disc to effect an automatic halving of the production rate for large diameter logs. FIGS. 15 and 16 show such a solution for dealing with large diameter logs.

FIGS. 15 and 16 show the log positioning means for the disc chipper of FIG. 14. The wear plate 120 mounted on the chipper disc 112 has a predetermined thickness to produce a chip of a standard length cut from logs of small and medium diameters at the sixteen knife position on the disc as indicated in FIG. 15. The next four chip layers of wood to be cut into chips are indicated by crosshatching. A stepped down portion 122 is provided at the inner margin of the wear plate 120 so that the radially inner portions of the longer knives 115 produce a chip that is approximately twice the length of the standard chip length at the outer perimeter of large diameter logs.

A biconvex portion of the outer margin of large diameter logs is cut by only the eight longer knives. The length of chips cut from such portion of the outer margin must be increased so that a full layer of wood is cut with the long knives that is substantially equivalent in thickness to the thickness of the layer of wood cut by the short knives over most of the length of the long knives, a substantially double thickness layer of wood being cut by the radially inner ends of the long knives. The stepped down portion 122 is necessary to enable such long chips to be cut. For example, if the wear plate 120 is set at a distance from the knife assemblies to produce a standard chip length of one inch from logs of small and medium diameters cut by all sixteen knives, the stepped down portion 122 must be set at a distance to produce approximately two inch chips from the biconvex portion of the outer margin of a large diameter log, cut by the eight long knives if the log positioning means of the present invention were not used.

FIG. 16 shows the log positioning means of the disc chipper of FIG. 14 in operation for a log **30*c* of large diameter which log positioning means does not come into operation during chipping of smaller diameter logs 30*b* as shown in FIG. 15. Specifically, in addition to the stepped down portion 122 of the wear plate 120, an intermediate raised log stop ring 124, comparable to the platform 28 in FIG. 5, is located radially between the stepped down portion 122 and the radially outer portion of wear plate 120 as shown in FIGS. 14, 15 and 16. The ring serves the purpose of slowing the feed rate for large diameter logs, so that a power saving is realized. When a log 30*c* has a diameter that would extend from the bottom of the trough 116 farther than the width of the wear plate 120, a radially outer biconvex portion of the margin of the log will abut the ring 124 as indicated in FIGS. 14 and 16. Since the log-engaging surface of the ring or platform 124 is spaced closer to the knife assemblies than the log-engaging surface of the wear plate 120** the knives will produce a shorter chip. Since a shorter chip is produced, less total wood will be chipped from the end of the log per revolution of the disc.

For example, if the ring 124 is set at a distance to produce chips $\frac{5}{8}$ inch long, i.e., is $\frac{3}{8}$ inch thick, instead of the standard 1 inch long chips which would be cut when the log end abuts the wear plate 120 as shown in FIG. 15 then the feed rate will slow from (1 inch) (sixteen knives)=sixteen inches per disc revolution to a feed rate of ($\frac{5}{8}$ inch) (sixteen knives)=ten inches per disc revolution. It should be appreciated that the biconvex portion of the outer margin of the large diameter log end cut by the radially inner ends of the long knives 115 will produce a $2\times\frac{5}{8}=1\frac{1}{4}$ inch chips allowed by the stepped down portion 122 of the wear plate 120 while the portions of the long knives 115 radially outward of the circle of the radially inner ends of the short knives will cut chips $\frac{5}{8}$ inch long. The short knives 117 will cut chips $\frac{5}{8}$ inch long. The next four layers of wood to be cut by the chipper are shown crosshatched in FIG. 16, two of which, cut by the long knives 115, are shown as stepped layers, the thickness of the radially outer portion being $\frac{5}{8}$ inch and the thickness of the radially inner portion being $1\frac{1}{4}$ inch.

The use of alternate short and long knife assemblies allows for more total knives on the disc than can otherwise be fitted on the disc. Thus, by using the log positioning means shown in FIGS. 14, 15 and 16, all knives can cut most of the logs that are fed to the chipper, small diameter logs **30*a* and medium diameter logs 30*b*, as shown in FIG. 15, and the production rate and chip quality will increase for the chipping of these logs. Meanwhile, the peak power requirement is not raised because the cutting of large diameter logs is slowed due to the abutment of the biconvex portion of the margins of the ends of such logs with the log position means 124 as indicated in FIG. 14 to reduce the log feed speed and consequently the chip length as shown in FIG. 16**.

The commonality of all the versions of the present invention is that they all have the advantage of the disc chipper having decreased power requirements as shorter chips are cut from large diameter logs. The power requirements of cutting the shorter chips is appreciably less than that of cutting standard length chips from large diameter logs. It should also be appreciated that in all the versions of the present invention the feed rate is slowed for large diameter logs. Consequently conveyor fed systems may need some type of sensing mechanism to slow the feed rate of logs to the chipper while a large diameter log is being cut.

I claim:

1. A disc chipper for chipping logs comprising:

a rotary disc having an outer surface facing incoming logs fed endwise to the chipper and at least one radial opening through the disc;

at least one knife assembly disposed on the disc adjacent to the radial opening;

at least one wear plate disposed on the outer surface of the disc adjacent to a knife assembly;

each wear plate having a log facing surface, and log positioning means extending from said log facing surface toward incoming logs for engagement thereby;

said log positioning means being positioned on the wear plate such that a portion of the margin of the end of a log of predetermined diameter or larger will engage said log positioning means;

whereby the feed rate of the log of predetermined diameter or larger to the disc will slow and save power required to rotate said disc.

2. The disc chipper of claim 1, wherein the tog position means comprises at least one raised platform having an outer surface facing incoming logs.

3. The disc chipper of claim 2, wherein the log position means comprise a single raised platform on each wear plate, the raised platform having an outer surface facing incoming logs.

4. The disc chipper of claim 3, wherein the outer surface of the raised platform is tapered.

5. The disc chipper of claim 3, wherein the outer surface of the raised platform is substantially parallel with the disc outer surface.

6. The disc chipper of claim 2, wherein the raised platform comprise multiple log stops radially spaced from the center of the disc, each log stop having an outer surface facing incoming logs.

7. The disc chipper of claim 6, wherein the log stops am arranged in a stepped configuration.

8. The disc chipper of claim 6, wherein adjacent log stops am separated by a gap.

9. The disc chipper of claim 2 wherein the raised platform is arcuate in shape.

10. A log chipper in combination with a large diameter log to be cut by said log chipper, comprising:

a rotary disc having an outer surface facing incoming logs fed endwise to the log chipper and at least one opening through said disc;

at least one radially elongated knife assembly disposed on said disc adjacent to said opening, the end of said large diameter log substantially spanning the full length of said knife assembly as said log is being cut by said knife assembly;

at least one wear plate disposed on the outer surface of said disc adjacent to a knife assembly, said wear plate being spaced a predetermined distance from said knife assembly to produce a chip of a predetermined standard length; and means for positioning the outer perimeter of said large diameter log such that said knife assembly cuts a chip of a length shorter than said standard length;

whereby the feed rate of said large diameter log to said disc will slow when said shorter chip is being cut from said large diameter log, and the slower feed rate will consequently save power required to rotate said disc.

* * * * *

UNITED STATES PATENT AND TRADEMARK OFFICE

CERTIFICATE OF CORRECTION

PATENT NO. : 5,417,263

DATED : May 23, 1995

INVENTOR(S) : Ray B. Jorgensen

It is certified that error appears in the above-indentified patent and that said Letters Patent is hereby corrected as shown below:

Claim 2: column 12, line 60, cancel "tog" and insert --log--;

column 12, lines 60 and 61, cancel "position" and insert --positioning--.

Claim 3: column 12, lines 63 and 64, cancel "position" and insert --positioning--;

column 12, lines 64 and 65, cancel "on each wear plate, the raised platform".

Claim 6: column 13, lines 4 and 5, cancel "raised platform" and insert --log positioning means--;

column 13, line 5, cancel "stops" and insert --stop platforms--;

column 13, line 6, after "stop" insert --platform--.

UNITED STATES PATENT AND TRADEMARK OFFICE

CERTIFICATE OF CORRECTION

PATENT NO. : 5,417,263

DATED : May 23, 1995

INVENTOR(S) : Ray B. Jorgensen

It is certified that error appears in the above-indentified patent and that said Letters Patent is hereby corrected as shown below:

Claim 7: column 13, lines 8 and 9, cancel "stops am" and insert --stop platforms are--.

Claim 8: column 13, line 11, cancel "stops am" and insert --stop platforms are--.

Claim 9: column 13, line 12, cancel "the" and insert --a--.

Signed and Sealed this

Twenty-fourth Day of February, 1998

*Attest:*

Bruce Lehman

BRUCE LEHMAN

*Attesting Officer*

*Commissioner of Patents and Trademarks*